US005800128A

United States Patent [19]

Bodmer et al.

[11] Patent Number: 5,800,128

[45] Date of Patent: Sep. 1, 1998

[54] FAN WITH INDIVIDUAL FLOW SEGMENTS CONNECTED TO A HUB WITH A PREFABRICATED THERMOPLASTIC STRIP

[75] Inventors: Urs Bodmer, Ennetbaden; Vishal Mallick, Birmenstorf, both of Switzerland

[73] Assignee: ABB Research Ltd., Zurich, Switzerland

[21] Appl. No.: 679,954

[22] Filed: Jul. 15, 1996

[30] Foreign Application Priority Data

Jul. 15, 1995 [DE] Germany ..... 195 25 829.0

[51] Int. Cl.[6] ..... B63H 1/16

[52] U.S. Cl. ..... 416/183; 416/186 R; 416/194; 416/230; 416/213 A

[58] Field of Search ..... 416/179, 183, 416/186 R, 194, 196 A, 230, 213 A

[56] References Cited

U.S. PATENT DOCUMENTS

| | | | |
|---|---|---|---|
| 1,873,974 | 8/1932 | Meyer | 416/183 |
| 2,155,231 | 4/1939 | Hubbard et al. | 416/230 |
| 3,070,844 | 1/1963 | Warnken . | |
| 3,515,501 | 6/1970 | Palfreyman et al. . | |
| 3,764,231 | 10/1973 | Hachiya et al. | 416/186 R |
| 4,676,722 | 6/1987 | Marchal et al. | 416/188 |

FOREIGN PATENT DOCUMENTS

| | | |
|---|---|---|
| 2024939 | 3/1971 | Germany . |
| 2538270 | 9/1976 | Germany . |
| 4139293A1 | 6/1993 | Germany . |
| 4139293C2 | 9/1993 | Germany . |
| 3523518C2 | 6/1994 | Germany . |

*Primary Examiner*—Thomas E. Denion

*Attorney, Agent, or Firm*—Burns, Doane, Swecker & Mathis, L.L.P.

[57] ABSTRACT

This fan is provided with an impeller (1), having a hub (2), and with a casing surrounding the impeller (1). The impeller (1) has individual flow segments (4) connected to the hub (2) and to one another and in each case enclosing a flow duct (5), and a shaft connected to the hub (2) and extending along an axis (3). The object is to provide a fan which has an impeller which can be easily produced from a plastic and is suitable for comparatively high operating speeds. This is achieved by the flow segments (4) being connected with a form fit to the hub (2), and by the fastening of the flow segments (4) being reinforced by means of at least one shrouding (13, 14) of a prefabricated thermoplastic strip reinforced with continuous fibers, the thermoplastic strip having been briefly heated and fused with the layer respectively applied previously during the winding of the shrouding (13, 14).

12 Claims, 2 Drawing Sheets

FAN WITH INDIVIDUAL FLOW SEGMENTS CONNECTED TO A HUB WITH A PREFABRICATED THERMOPLASTIC STRIP

BACKGROUND OF THE INVENTION

1. Field of the Invention

The invention is based on a fan for gaseous fluids according to the preamble of claim 1.

2. Discussion of Background

The patent DE 41 39 293 C2 discloses a fan which can be used, for example, for ventilation systems. The fan has an impeller fitted with flow segments. These flow segments are joined to one another integrally or with a form fit and they are additionally reinforced and provided with a bottom disk and/or a top disk. The bottom disk is additionally designed as a hub and it serves for the connection to the shaft driving the impeller. Depending on the design of the bottom disk, it may also increase the mechanical strength of the flow segments. The top disk lends the impeller additional mechanical strength. The fitting of the top disk onto the joined together flow segments is comparatively laborious and causes considerable assembly costs.

The flow segments are produced from plastic reinforced with chopped fibers. In spite of the mechanical reinforcement by the top disk, this impeller is only suitable under certain conditions for relatively high speeds.

SUMMARY OF THE INVENTION

Accordingly, one object of the invention, as defined in the independent claims, is to provide a novel fan which has an impeller which can be easily produced from a plastic and is suitable for comparatively high operating speeds.

To be regarded as the advantages achieved by the invention are that the operating temperature and the speed of the fan, and consequently its efficiency, is significantly increased in comparison with fans which are equipped with conventional compressor impellers of plastic. Now, operating temperatures of up to about 250° C. are possible, and circumferential speeds of about 400 m/sec.

The impeller has a comparatively smaller mass and it can be assembled comparatively easily from different individual parts. In the case of a particularly preferred embodiment of the impeller, a prefabricated, carbon fiber reinforced thermoplastic strip is used for producing the shroudings reinforcing the structure of the impeller. In this thermoplastic strip, the orientation of the continuous reinforcing fibers is always optimally ensured, with the result that a comparatively good strength of the impeller is ensured even at comparatively high operating temperatures and circumferential speeds. Thanks to the comparatively low mass of the impeller, it also has a small moment of inertia, with the result that the fan compressor reaches the required operating speed in an advantageously short time upon starting and consequently is fully effective very quickly.

The further developments of the invention are the subject of the dependent claims.

BRIEF DESCRIPTION OF THE DRAWINGS

A more complete appreciation of the invention and many of the attendant advantages thereof will be readily obtained as the same becomes better understood by reference to the following detailed description, which represents only one possible way of implementing it, when considered in connection with the accompanying drawings, wherein.

DESCRIPTION OF THE PREFERRED EMBODIMENTS

Figure 1A:
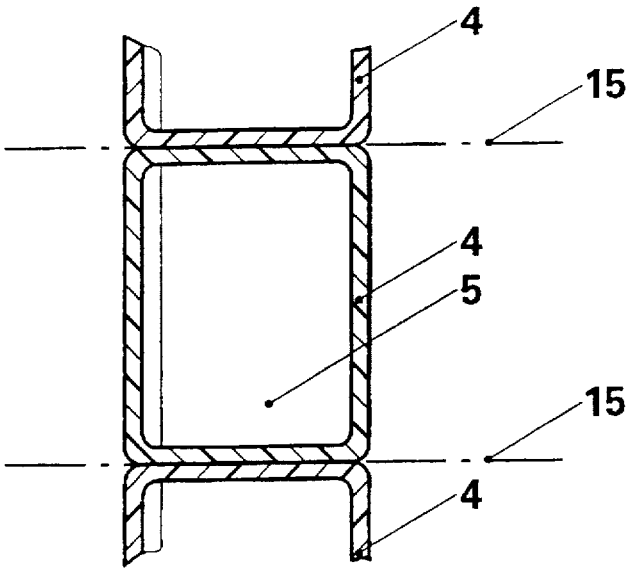
FIG. 1*a* shows a second partial section through the first embodiment of the impeller.
Figure 1:
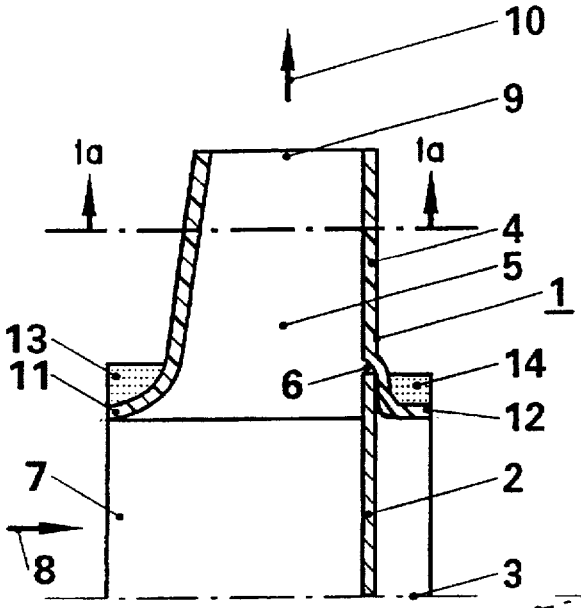
FIG. 1 shows a first partial section, represented in greatly simplified form, through a first embodiment of an impeller.

Referring now to the drawings, wherein like reference numerals designate identical or corresponding parts throughout the several views and all elements not required for a direct understanding of the invention have been omitted, in FIG. 1 there is shown a schematically represented partial section through an impeller 1, as is used in a fan for the compression of a gaseous fluid. The casing, enclosing the impeller 1, for feeding in and discharging the gaseous fluid is not shown. The impeller 1 has a hub 2, which is designed here in the form of a plate and is generally produced from a metal. If the hub 2 is produced from a plastic, it preferably consists of a thermoplastic material reinforced with continuous fibers, but it is also possible to produce the hub 2 from a thermoset material. The hub 2 is provided with fastening means (not shown), with the aid of which it can be connected to a shaft driving the impeller 1. This shaft extends along an axis 3, which represents the central axis of rotation of the impeller 1. The hub 2 is connected to a multiplicity of flow segments 4. Flow segments 4 are designed in the form of boxes, as the section A—A represented in FIG. 1*a* shows. The flow segments 4 in each case enclose a flow duct 5, which has a cross section increasing constantly outward from the hub 2, here for example a rectangular cross section. The outer end of the hub 2 is let into a recess 6 of the wall of the flow segments 4 with a form fit. The entire circumference of the hub 2 of the impeller 1 is fitted with flow segments 4 arranged in series alongside one another. The prefabricated flow segments 4 are joined together both with the hub 2 and with one another in a mechanically sturdy manner. The flow segments 4 are produced by one of the known processes, generally from a thermoplastic material, but they may also consist of a thermoset material. The flow segments 4 may also be wound from a prefabricated plastic strip reinforced with continuous fibers.

The impeller 1 has an inflow opening 7, through which the gaseous fluid flows in axially in the direction of an arrow 8. The flow is deflected by the hub 2 into the flow duct 5, which runs predominantly in a radial direction. In the flow duct 5, the gaseous fluid is accelerated in a known way and thereby compressed. The compressed gaseous fluid leaves the flow duct 5 through an outflow opening 9 of a rectangular cross section. This outflow opening 9 may also have different cross sections. The direction of the outflowing gaseous fluid is indicated by an arrow 10. The outflowing gaseous fluid is collected in a casing (not shown) designed to have favorable flow characteristics and, in this casing, is discharged for further use. The flow segments 4 have on the side of the inflow opening 7 a formed-on shoulder 11 and may also have on the side opposite this shoulder 11 a further shoulder 12, which merges into the recess 6. These shoulders 11 and 12 are in each case wound with a shrouding 13, 14 once all the flow segments 4 have been joined together with the hub 2.

The shoulder 11 is provided with the shrouding 13, the shoulder 12 is provided with the shrouding 14. The shroudings 13 and 14 are wound from a prefabricated plastic strip reinforced with continuous fibers. Suitable in this case as the plastic are particularly temperature-resistant thermoplastics, and carbon fibers are used for the reinforcement. Under certain conditions, the shroudings 13 and 14 may also have a matrix of thermoset material. The shroudings 13 and 14 are wound such that the carbon fibers are arranged in the circumferential direction, which has as a consequence a particularly high strength of the shroudings 13 and 14 in this direction. These shroudings 13 and 14 hold the impeller 1 mechanically together, in addition to the adhesive bonds or welded joints, and permit comparatively high speeds of this impeller 1, and consequently comparatively great efficiencies of the fan. During the winding, if a thermoplastic strip is used, the thermoplastic material of the strip is briefly heated and fused with the layer of the strip respectively applied previously. Particularly suitable for this specifically directed and apportioned brief heating is a laser. Such thermoplastic winding processes using lasers as an energy source are known. After the completion of the winding operation, the surfaces of the shroudings 13 and 14 may be finished, should this be necessary. If the flow segments 4 are produced from thermoplastic, the respectively first layer of the shroudings 13 and 14 may be fused directly with the material of the flow segments 4, with the aid of the laser, with the result that a particularly good and mechanically sturdy bonding is produced between the flow segments 4 and the shroudings 13 and 14.

Figure 1B:
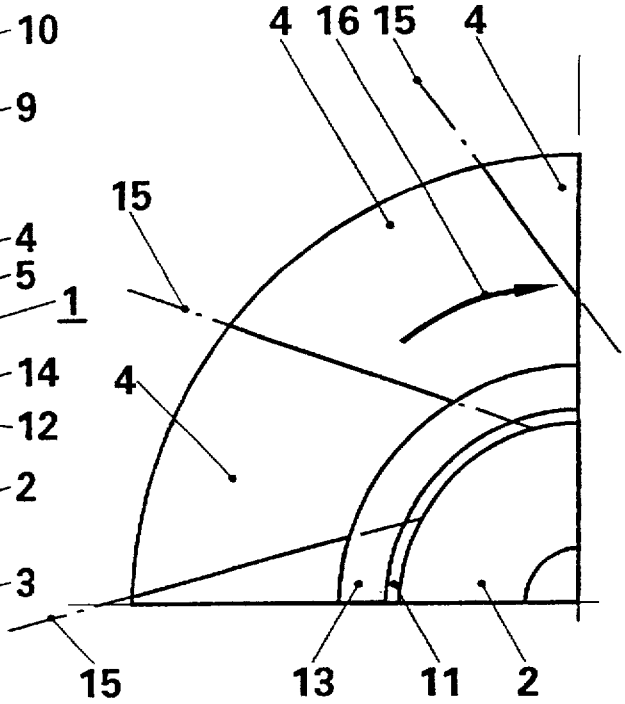
FIG. 1*b* shows a plan view of a segment of the first embodiment of the impeller.

As already described, the entire circumference of the hub 2 of the impeller 1 is fitted with flow segments 4 arranged in series directly alongside one another. The flow segments 4 are joined together both with the hub 2 and with one another in a mechanically sturdy manner. In the case of this embodiment of the impeller 1, the contact surfaces between the individual flow segments 4 are planar. In FIG. 1*a* and in FIG. 1*b*, the contact surface between in each case two flow segments 4 is respectively indicated by a dash-dotted line 15. The flow segments 4 are likewise connected to one another at their contact surfaces, they may be welded to one another or joined together by adhesive bonding with one another and with the hub 2 to form a compact, mechanically-very sturdy impeller 1. By virtue of the exact adaptation of the contact surfaces to one another, uniform adhesive joints are obtained, permitting particularly durable adhesion. In FIG. 1*b*, an arrow 16 indicates the direction of rotation of the impeller 1.

Figure 2:
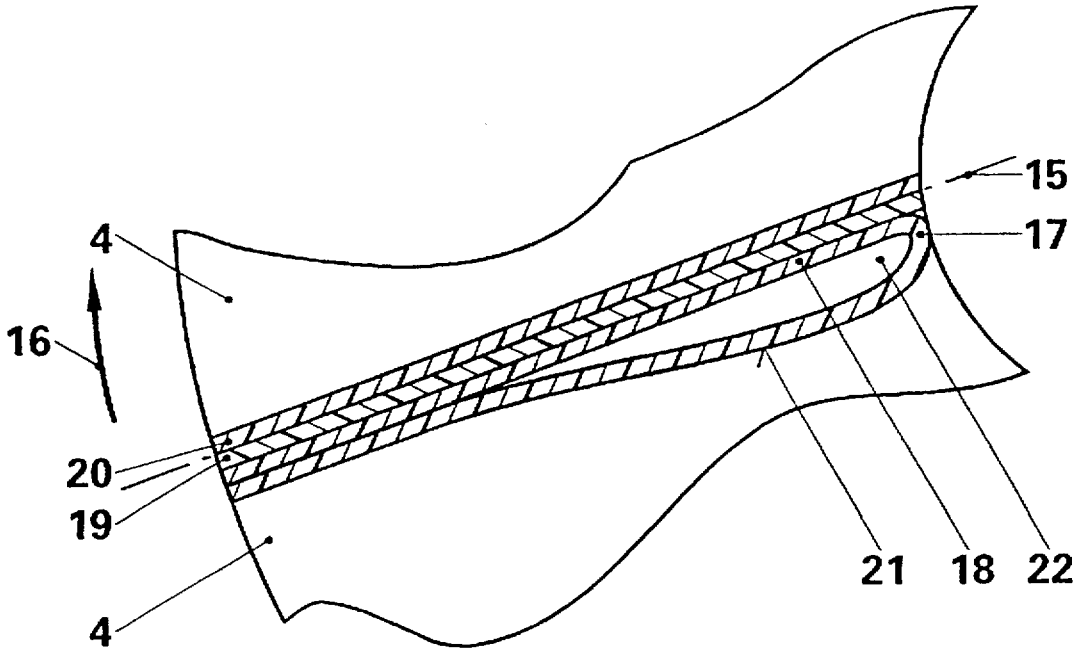
FIG. 2 shows a partial section through a second embodiment of an impeller.

The flow ducts 5 may also be designed in a known way to have favorable flow characteristics on the inside; the corresponding spherical curvature of the side walls is not shown in the drawing, for the sake of better overall clarity. However, it is possible in a simple manner to design straight sidewalls of the flow segments 4 with somewhat more favorable flow characteristics, as can be seen from FIG. 2. There, an expediently designed flow profile piece 17, which has a planar rear wall 18, is connected to a planar sidewall 19 of the flow duct 5. The flow profile piece 17 was subsequently introduced into the flow duct 5 and adhesively bonded or welded to the sidewall 19 such that it completely covers the latter. The sidewall 19 is connected on the side facing away from the flow profile piece 17 to a sidewall 20 of the adjoining flow segment 4, to be precise, as already described, by an adhesive bonding or by a welding. The planar rear wall 18 and the wall 21, designed to have favorable flow characteristics and facing the interior of the flow duct 5, of the flow profile piece 17 are formed here, for example, from a sheet of plastic of uniform thickness reinforced with continuous fibers; it encloses a hollow space 22 becoming narrower in the radial direction. To achieve better vibration damping, this hollow space 22 may be filled with foam.

Figure 3:
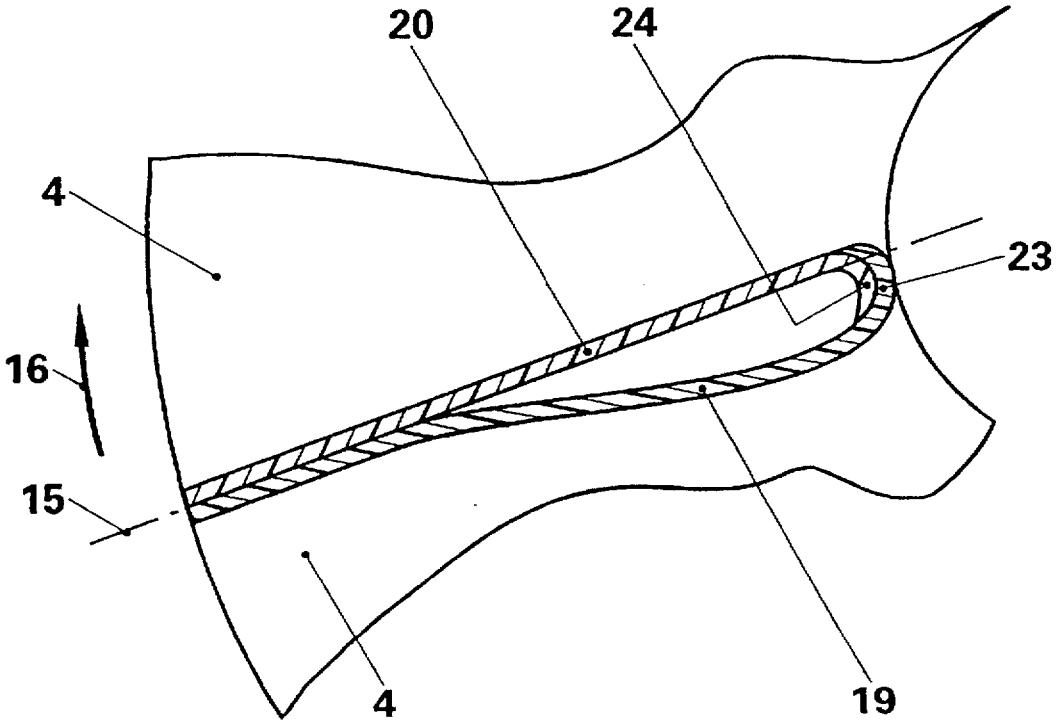
FIG. 3 shows a partial section through a third embodiment of an impeller.

Instead of the separately installable flow profile piece 17 with the wall 21 designed to have favorable flow characteristics, the sidewall 19 may itself be designed to have favorable flow characteristics, as is shown in FIG. 3. Formed onto the piece of the sidewall 19 provided with the profile designed to have favorable flow characteristics is a nose 23, which is intended for the connection with a form fit to a counterpiece 24, which is formed onto the neighboring sidewall 20 and corresponds to the nose 23. This connection with a form fit may be designed as a snap connection, which generally is additionally adhesively bonded or welded.

Moreover, the impeller 1 may be provided with a balancing ring of metal, which was let into one of the shroudings 13 or 14 during its winding in such a way that it partly protrudes from said shrouding. During the balancing of the finished impeller 1, material can then be removed from this balancing ring in order to eliminate any existing imbalances. It is also possible, however, to make one of the shroudings 13 or 14 itself of a greater mass and to perform the necessary material removal on these shroudings 13 or 14, obviating the need for a separate balancing ring, which makes production of the impeller 1 less costly in an advantageous way.

For the connection of the flow segments 1 to the hub 2 and for the adhesive bonding of the contact surfaces, indicated by the dash-dotted line 15, of the flow segments 4, an adhesive based on a phenolic resin is envisaged; the adhesive HT 424 from the American Cyanamid Company, 1300 Revolution Street, Havre de Grace, Md. 21087, has proved to be particularly suitable here. Furthermore, the adhesive based on a modified condensation polyimide of the same producer with the designation FM 36 is also well suited for the joining together described here. Apart from the adhesives mentioned, a welding operation or a combination of these two processes may also be provided for the connecting of the parts described.

The strip for the production of the shroudings 13 and 14 has a thermoplastic matrix. Polyphenylene sulfide in particular has proved to be successful here as the thermoplastic; furthermore, good results have been achieved with polyetherether ketone. The polyphenylene sulfide matrix was reinforced with a volume content of carbon.fibers of about 53%. The cross section of this strip was 5 mm * 0.158 mm. The resulting modulus of elasticity of the strip was 114 GPa. The operating temperature was in this case about 220° C. The polyetherether ketone matrix was reinforced with a volume content of carbon fibers of 61%. The cross section of this strip was 5 mm * 0.125 mm. The resulting modulus of elasticity of the strip was 134,000 MPa. The operating temperature in this case was about 250° C.

Used as the material for producing the flow segments 4 and the flow profile pieces 17 is a thermoplastic reinforced with carbon fibers in the form of continuous fibers. A polyetherether ketone matrix with a volume content of carbon fibers of 61% has proved to be particularly suitable. The flow segments 4 are prefabricated with the aid of one of the known processes, it being ensured that the continuous fibers are oriented in the direction of principal dynamic stress of the flow segments 4. The flow segments 4 prefabricated in this way are then joined together, together with the hub 2, in an assembly fixture and are then adhesively bonded or welded in this fixture to form the finished impeller 1. The impeller 1 of the thermoplastic materials described is suitable for use at operating temperatures up to about 250° C. and for circumferential speeds of about 400 m/sec.

However, it is possible in principle also to produce the impeller 1 from thermoset materials or from a combination of components of thermoset materials with components produced from thermoplastic materials.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A fan comprising an impeller having a hub, a plurality of individual flow segments connected to the hub and to one another, each flow segment comprising and enclosing a flow duct a shaft connected to the hub and extending along an axis;

the flow segments connected with a form fit to the hub; and at least one shrouding positioned to reinforce the connection of said plurality of individual flow segments, said at least one shrouding comprising a prefabricated thermoplastic strip reinforced with continuous fibers and including a top surface and a bottom surface, the thermoplastic strip having been wound onto said impeller such that a portion of said bottom surface is immediately adjacent to portion of said top surface, said portion of said bottom surface heat fused to said portion of said top surface.

2. The fan according to claim 1, wherein the flow segments are wound in layers from a thermoplastic strip reinforced with continuous fibers.

3. The fan according to claim 1, wherein a prefabricated, carbon fiber reinforced thermoplastic strip is used for the winding of the shroudings.

4. The fan according to claim 3, wherein said thermoplastic strip is formed from a matrix selected from the group consisting of polyphenylene sulfide and polyetherether ketone.

5. The fan according to claim 1, wherein the flow segments are joined together from at least two preformed individual parts.

6. The fan according to claim 5, wherein the individual parts of the flow segments are joined together by a means selected from the group consisting of adhesive bonding and welding.

7. The fan according to claim 1, wherein each flow duct has at least one sidewall which is provided with a profile designed to have favorable flow characteristics.

8. The fan according to claim 7, further comprising at least one flow profile piece covering said at least one sidewall.

9. The fan according to claim 7, further comprising a second sidewall including a counterpiece, wherein the at least one sidewall further comprises a nose for connecting with a form fit to said counterpiece.

10. The fan according to claim 2, wherein the flow segments are constructed of a wound, prefabricated, carbon fiber reinforced thermoplastic strip.

11. The fan according to claim 10, wherein said flow segments' thermoplastic strip is formed from a matrix selected from the group consisting of polyphenylene sulfide and polyetherether ketone.

12. The fan according to claim 2, wherein said flow segments' thermoplastic strip includes a top surface and a bottom surface, and said flow segments' thermoplastic strip has been wound such that a portion of said bottom surface is immediately adjacent to portion of said top surface, said portion of said bottom surface heat fused to said portion of said top surface.

* * * * *